US008292639B2

(12) United States Patent
Achammer et al.

(10) Patent No.: US 8,292,639 B2
(45) Date of Patent: Oct. 23, 2012

(54) COMPLIANT PIN CONTROL MODULE AND METHOD FOR MAKING THE SAME

(75) Inventors: Daniel G. Achammer, Warrenville, IL (US); Gregory R. Pratt, Naperville, IL (US); Thomas G. Premo, Downers Grove, IL (US); Sasikumar Vimalan, Aurora, IL (US); Christopher J. Vetch, Lincoln, NE (US)

(73) Assignee: Molex Incorporated, Lisle, IL (US)

( * ) Notice: Subject to any disclaimer, the term of this patent is extended or adjusted under 35 U.S.C. 154(b) by 342 days.

(21) Appl. No.: 12/305,727

(22) PCT Filed: Jul. 2, 2007

(86) PCT No.: PCT/US2007/072684

§ 371 (c)(1),
(2), (4) Date: May 4, 2010

(87) PCT Pub. No.: WO2008/005945

PCT Pub. Date: Jan. 10, 2008

(65) Prior Publication Data

US 2010/0317239 A1 Dec. 16, 2010

Related U.S. Application Data

(60) Provisional application No. 60/818,091, filed on Jun. 30, 2006.

(51) Int. Cl.
*H01R 12/00* (2006.01)

(52) U.S. Cl. ..... 439/76.2; 439/949; 29/832

(58) Field of Classification Search ..... 439/76.1, 439/76.2, 949, 751, 733.1; 29/832
See application file for complete search history.

(56) References Cited

U.S. PATENT DOCUMENTS

| | | | | |
|---|---|---|---|---|
| 5,879,200 | A * | 3/1999 | Sugie | 439/733.1 |
| 7,125,285 | B2 * | 10/2006 | Maejima et al. | 439/82 |
| 7,492,600 | B2 * | 2/2009 | Kane | 361/752 |
| 2003/0162421 | A1 | 8/2003 | Pratt et al. | |
| 2004/0005794 | A1 | 1/2004 | Yamashita | |
| 2005/0122694 | A1 | 6/2005 | Kane | |

FOREIGN PATENT DOCUMENTS

DE 10-2004-060302 A1 7/2005

OTHER PUBLICATIONS

International Search Report for PCT/US2007/072684.

* cited by examiner

*Primary Examiner* — Ross Gushi
(74) *Attorney, Agent, or Firm* — Larry I. Golden

(57) ABSTRACT

Control modules having connectors with compliant pin terminals for connection to a printed circuit board (PCB) are provided. The module housing can be made of a die cast metal to withstand harsh environments and have at least one open bay area for receiving a connector having compliant pin contacts for connecting the module to a PCB. A plurality of compliant pin terminal can have a push shoulders for providing an engagement surface for insertion of the terminals through passages in a connector housing, for positioning the connector relative to the die cast housing during the mounting the connector to the die cast housing, and to transfer the force away from the connector housing applied in connecting the PCB to the compliant pin tips. The connectors can be linear and exposed terminal surfaces can be sealed against the elements by a sealant. The passages of the connector housing can have at one end of the passages cross shaped portions to allow for a strengthened die tool which forms the small passages and chamfered sides at the opposite end of the passages for tight engagement with the terminals to prevent leak of sealant. The connectors can include a three-pronged compliant pin grounding terminal to increase the current flow.

38 Claims, 11 Drawing Sheets

COMPLIANT PIN CONTROL MODULE AND METHOD FOR MAKING THE SAME

This application claims priority to U.S. Provisional Application Ser. No. 60/818,091 filed Jun. 30, 2006, which is incorporated herein by reference in its entirety.

BACKGROUND OF THE INVENTION

The present invention is directed generally to electronic control modules. More particularly, the present invention is directed to electronic control modules having compliant pin contacts or terminals for interfacing to a printed circuit board (PCB) and methods for manufacturing such control modules. Even more specifically, the invention is directed to a control module having a die cast housing having at least one open bay area for receiving a connector having compliant pin contacts for connecting the module to a PCB.

Typical die cast modules have wire contacts that require soldering to connect the contacts to the PCB. Soldering is expensive, has the potential for being associated with environmental hazards and is prone to cracking over time. Compliant pin contacts require a straightforward press-fit or interference connection with the PCB. Mounting compliant pin contacts to die cast modules has not been commercially feasible. One difficulty that the present approach has recognized and addressed is a certain level of variability inherent in mass produced die cast housings that prevents the precise placement of the compliant pins needed to achieve proper and consistent operation. Precise placement is a necessity because the PCB connection tip of the compliant pins must be centered in the PCB upon mounting of the PCB to the die cast housing. Another issue involved in providing a integrated control module, i.e. a preassembled control module having compliant pin connectors for later addition of a PCB by the end used, is that each component of the integrated control module introduces variability in the tolerances in the final integrated control module. The relative tight tolerances required in precisely placing compliant pin terminals for mating to a PCB make integrating the compliant pin connector to a control module housing have prevented a viable solution.

U.S. Pat. No. 6,773,272, which is incorporated herein by reference, discloses a module having two right-angled electrical connectors. The module housing is a box structure assembled of plastic walls. The right-angled connectors are supported by a connector alignment member at the contact mating end and a plastic pin alignment plate having stop shoulders to engage push shoulders on the compliant pin end. The entire force applied to mount PCB to the compliant pin ends is transmitted to the plastic pin alignment plate.

The present disclosure provides an approach by which a control module having compliant pin connectors can withstand the heat, moisture, and vibration found in difficult environments such as automotive or vehicular applications. In on aspect of the present approach, linear connectors having compliant pin terminals or contacts are precisely and nearly permanently positioned relative to certain reference points on the die cast module housing and in a manner allowing for sealing of exposed terminal portions. In this aspect, push shoulders on the compliant pin terminals are supported independently of the connector or shroud housing and by positioning the terminals by reference to the push shoulders and certain places of the die cast housing reliable electrical engagement with a PCB is assured without risking deformation of the connector and the resulting misalignment of terminals. The present disclosure also provides methods for the production of such control modules.

SUMMARY OF THE INVENTION

In one aspect of the presently disclosed approach, a control module is provided. The control module comprises a module housing having opposing first and second sides and a bay opening therethrough, and a connector extending through the bay and mounted to the module housing. The connector includes a housing having a printed circuit board side and a mating side and a core on the printed circuit board side and a plurality of conductive terminals. The core includes passages having opposing first and second openings. The first opening is positioned at the printed circuit board side of the housing and the second opening is positioned at the mating side of the housing. Each conductive terminal extends through one of the passages and has a compliant pin portion at one end for insertion in a hole in a printed circuit board and a contact portion at an opposite end for insertion in an opening in a complementary connector. The compliant pin portion extends out from the first opening and towards the printed circuit board side and the contact portion extends out from the second opening and towards the mating side of the connector housing.

In another aspect of the presently disclosed approach, an electrical connector is provided. The electrical connector comprises a housing having a printed circuit board side and a mating side, a core on the printed circuit board side, and a plurality of conductive terminals. The core includes a plurality of passages having opposing first and second openings. Each conductive terminal extends through one of the plurality of passages and has a compliant pin portion at one end for insertion in a hole in a printed circuit board having a predetermined thickness and a contact portion at an opposite end for insertion in an opening in a complementary connector. The compliant pin portion extends out from the first opening and towards the printed circuit board side and the contact portion extends out from the second opening and towards the mating side.

In another aspect of the presently disclosed approach, a method of making a control module is provided. The method comprises the steps of: providing a control module housing having opposing first and second sides and a bay opening therethrough. The second side includes at least one pad. Providing a connector including a plurality of terminals. Each terminal has a compliant pin portion at one end of the terminal for insertion in a hole in a printed circuit board, a contact portion at an opposite end of the terminal for insertion in an opening in a complementary connector, and a push shoulder therebetween. Each terminal extends through and is secured to one of the passages. Providing an alignment tool including a pin support tower having a top surface and at least one post having a top surface. The top surfaces are vertically spaced apart a predetermined distance X from each other. Placing the connector on the alignment tool wherein the push shoulders are supported on the pin support tower. Mounting the connector to the control module housing including the steps of bringing control module housing and connector together such that the connector passes through bay and at least one pad contacts at least one post.

Other aspects, objects and advantages of the present invention will be understood from the following description according to the preferred embodiments of the present invention, specifically including stated and unstated combinations of the various features which are described herein and relevant information which is shown in the accompanying drawings and examples.

BRIEF DESCRIPTION OF THE DRAWINGS

FIG. 8 is a perspective view of the compliant pin grounding terminal shown in FIG. 11.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific details disclosed herein are not to be interpreted as limiting, but merely as a basis for the claims and as a representative basis for teaching one skilled in the art to variously employ the present invention in virtually any appropriate manner.

Figure 1:
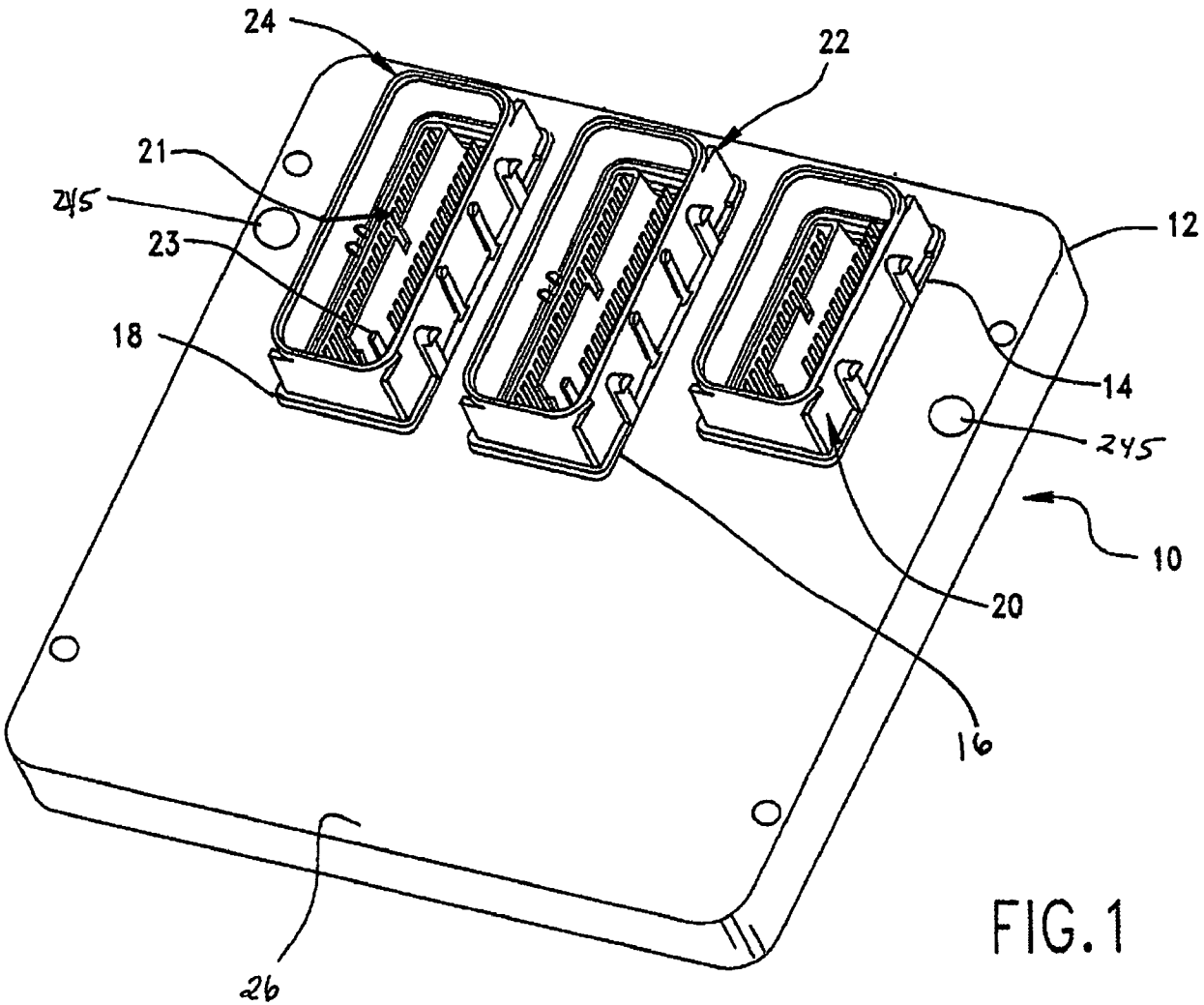
FIG. 1 is a perspective view of one embodiment of a compliant pin control module according to the present invention.

FIG. 1 illustrates one embodiment of compliant pin control module 10 of the present invention. A housing 12 shown in FIG. 2 has three bays 14, 16, 18 for receiving respective connectors 20, 22, 24 each of which can have numerous compliant pin terminals or contacts 21 as shown in FIG. 1. Control module housing 12 can be molded plastic or die cast from metal or from a metal alloy and thus made relatively inexpensively. They can be made of any metal or plastic suitable for the intended end use. Often aluminum and/or aluminum containing alloys will be used. The control module housing can have one or more bays for receiving connectors depending on the application. For example, three connectors 20, 22, 24 which also are known as compliant pin shroud assemblies, are shown in FIG. 1. While from time to time three connector systems are shown and described herein for illustrative purposes it will be understood that less than or greater than three connectors are intended.

Figure 2:
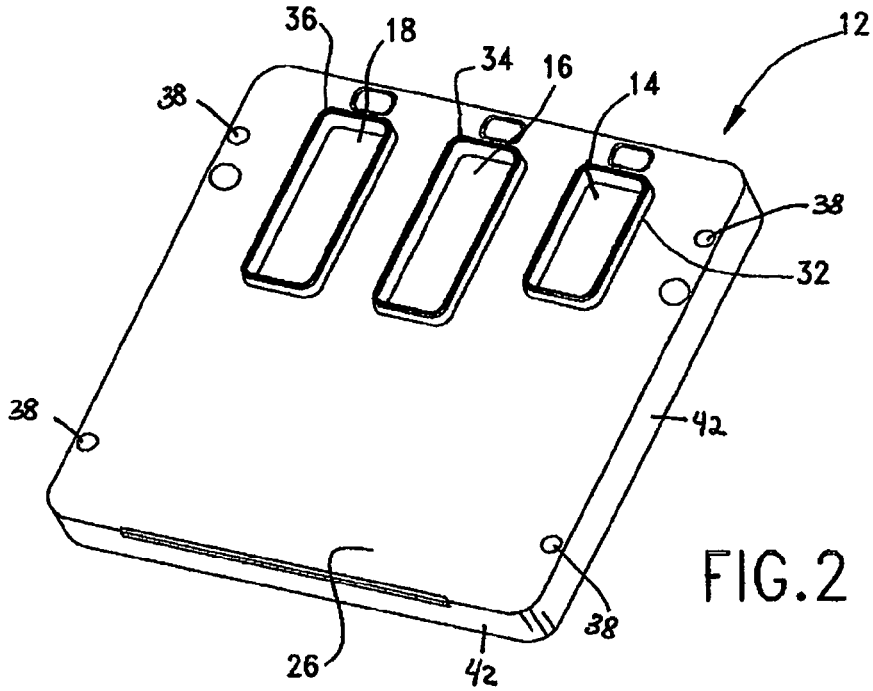
FIG. 2 is a perspective view of the mating side of the control module housing shown in FIG. 1 having three empty bays, each of which can receive compliant pin connectors.
Figure 3:
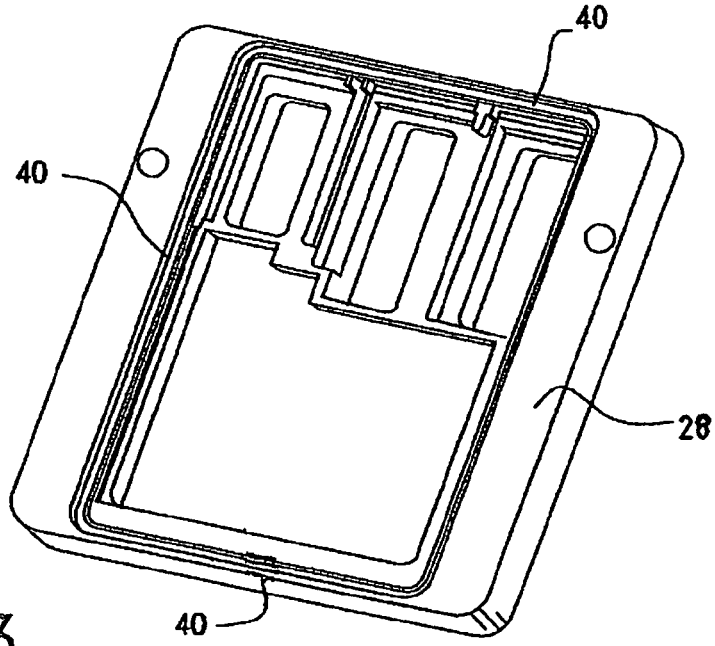
FIG. 3 is a perspective view of the printed circuit board side of the control module housing shown in FIG. 2.

Mating side 26 of housing 12 shown in FIGS. 1 and 2 is so named to refer to the side on which complementary connectors (not shown) will mate with connectors 20, 22, 24. Each also has a PCB side 28 shown in FIG. 3 which is the side of the housing 12 where a PCB can be mounted. Mating side 26 can have a set of fins (not shown) for heat dissipation, and each of bays 14, 16, 18 can have a rib 32, 34, 36 respectively encircling the bay and extending up from side 26 of housing 12 for mounting a shroud assembly to housing 12, which will be discussed in more detail below. Mating side 26 can also have four pads 38 near each corner of the housing, if applicable. Pads 38 generally reside on the same plane which is substantially perpendicular to sides 42 of module housing 12. Pads 38 can serve as reference points for the precise placement of compliant pin terminals 21 relative to housing 12 via precise placement of one or more shroud assemblies. In particular, pads 38 allow precise placement of compliant pin terminals 21 at the chosen vertical height in module housing 12 by spacing the compliant pin terminals 21 at a certain position, such as push shoulders discussed below, a predetermined vertical distance from the pads 38. Since pads 38 are maintained or machined to be a set predetermined vertical distance from the PCB ledge 40, precise placement of the compliant pins 21 is attained.

PCB side 28 can have PCB ledge support 40 around housing 12. PCB ledge support can also serve to provide reference points for the precise placement of compliant pins 21 via precise placement of one or more shroud assemblies.

Moving now to the connectors or shroud assemblies that can be mounted on the control module, it can be seen that control module 10 has three connectors or shroud assemblies 20, 22, 24. The shroud assemblies can be designed to have a variety in number and arrangement of compliant pins 21. As shown in FIG. 1 shroud assembly 20 is a 56-Way compliant pin shroud assembly having fifty-six compliant pins 21, and shroud assemblies 22, 24 are 73-Way compliant pin shroud assemblies each have seventy-two compliant pin terminals 21 and one three-pronged compliant pin grounding terminal 23.

Even though both shroud assemblies 22, 24 have the same number of compliant pin terminals 21 and compliant pin grounding terminal 23, the keying structures for each shroud housing can be different. The description that follows for shroud assembly 22 is for a shroud housing having particular mating structures for a specific use, and it will be appreciated that other mating structures may be provided that vary from application to application. Otherwise the description is also equally applicable to shroud assemblies 20, 24 except that shroud assembly 20 has a different number of compliant pin terminals 21 and lacks a three-pronged compliant pin grounding terminal 23. Both can have different shroud housing keying structures.

Figure 4:
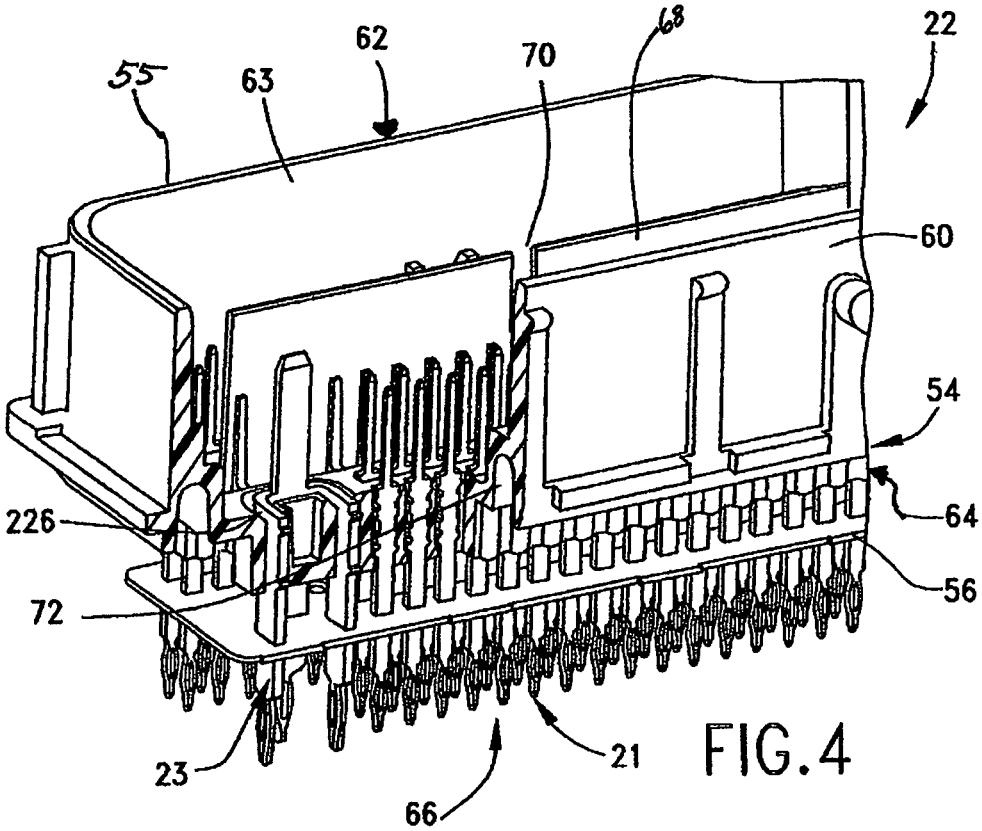
FIG. 4 is a perspective view of the right side of one embodiment of a connector or shroud assembly of the present invention having a portion of the shroud housing cut away.
Figure 5:
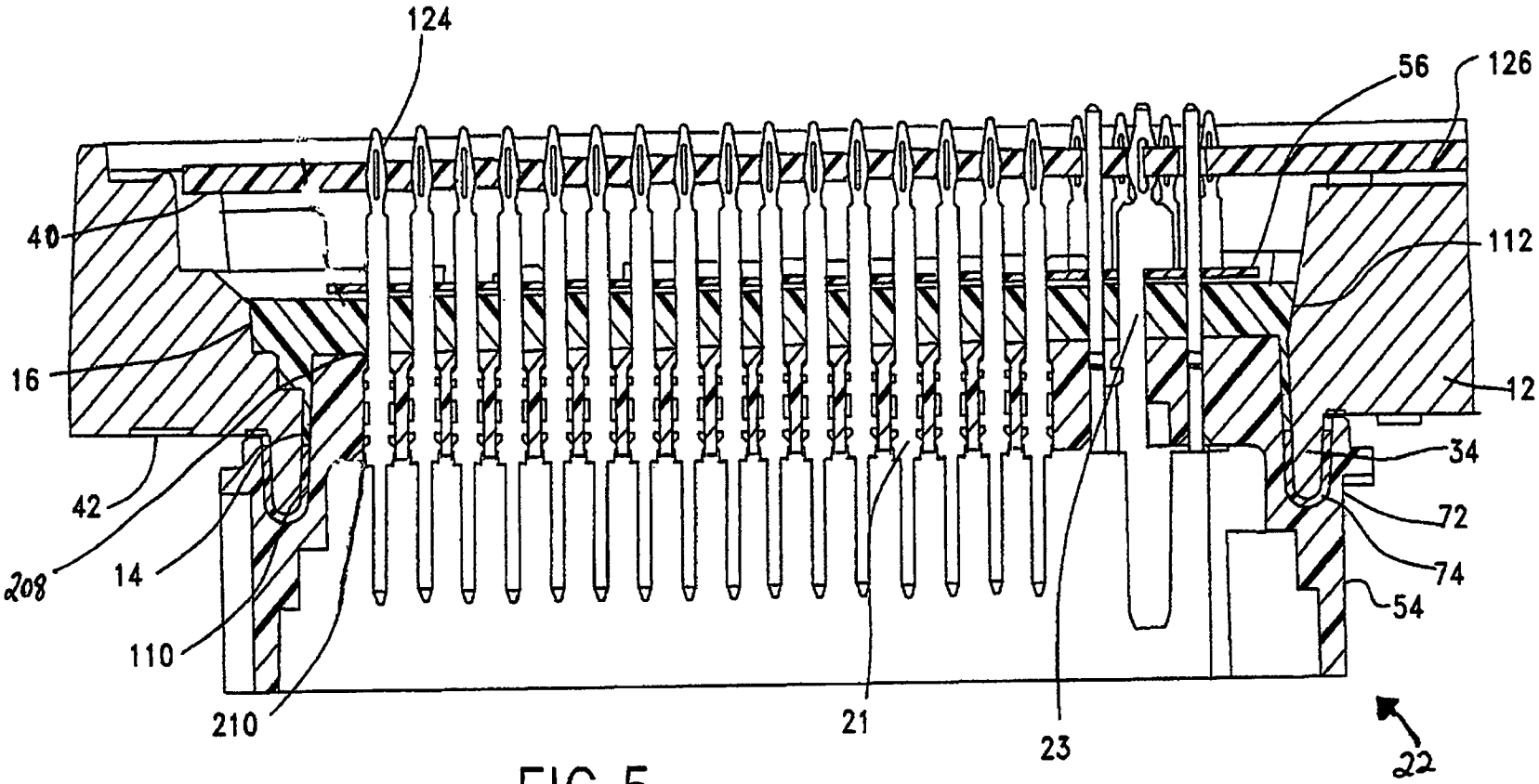
FIG. 5 is an elevation view of a cross-section of the compliant pin control module shown in FIG. 1 showing the shroud assembly mounted to the control module housing.

As shown in FIG. 4, shroud assembly 22 can have shroud housing 54, compliant pin terminals 21, three-prong compliant pin grounding terminal 23 and pin alignment plate 56. Housing 54 can be made of a dielectric such as plastic or other such material and can be made using any known manufacturing technique, such as injection molding. Housing 54 can have a skirt 60 positioned on mating side 62 of the shroud assembly 22 and ending at skirt face 55. Core 64 in which compliant pin terminals 21 extend through is positioned on PCB side 66 of shroud assembly 22. A tongue 68 is centrally located in the cavity defined by skirt 60 and can have a slot 70 separating tongue 68 into two sections. Surrounding core 64 is channel or groove 72. As shown in FIG. 5, channel 72 can receive rib 34 of housing bay 16 and an amount of adhesive 74 to mount shroud assembly 22 to die cast housing 12. The other illustrated shroud assemblies 20 and 24 can be mounted in the same manner.

Figure 6:
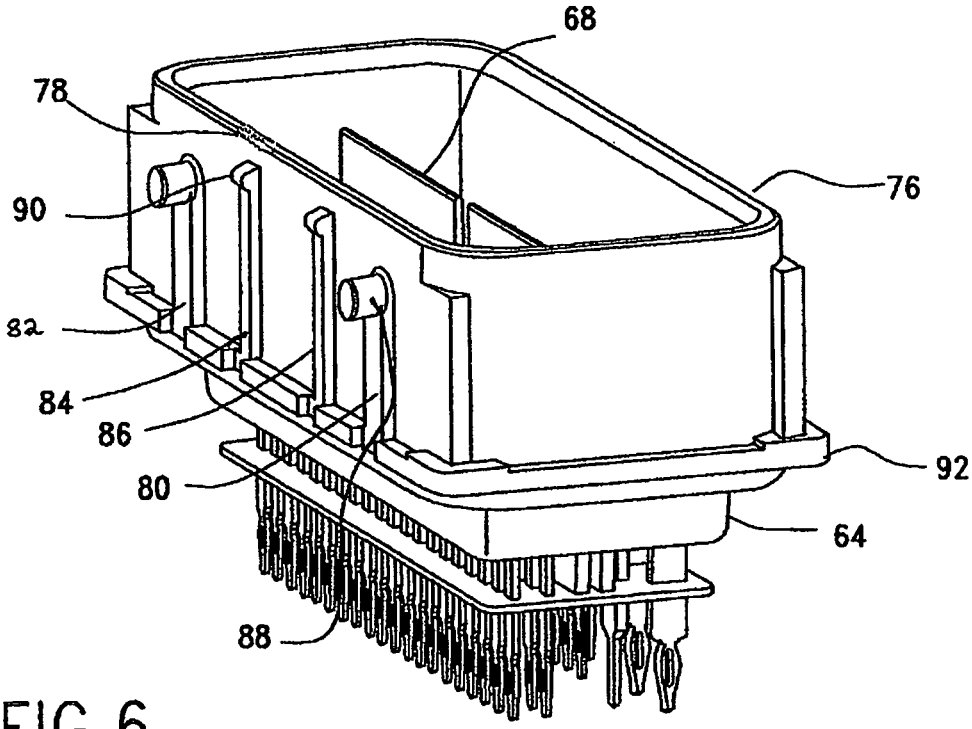
FIG. 6 is a perspective view of the left hand side of the shroud assembly shown in FIG. 4.

Each of two opposing walls 76, 78 (FIG. 6) of skirt 60 run parallel with mating alignment tongue 68 and can include two wide posts 80, 82 adjacent the corners of skirt 60 and two thinner posts 84, 86 between wide posts 80, 82 as shown in FIG. 6. Mating alignment tongue 68 assists in keeping shroud assembly 22 and a complementary connector properly aligned to prevent damaging compliant pin terminals 21. Each wide post 80, 82 can have knob 88 and each thin post 84, 86 can have button 90 extending perpendicular from, skirt 60 toward the exterior of the shroud assembly 22. A ledge 92 extends perpendicular from skirt 60 towards the exterior of the shroud assembly 22 and surrounds the skirt 60 except for interruptions at the base of posts 80, 82, 84, 86. A mating connector (not shown) has complementary structures for interference type locking with the mating side 62 of shroud assembly 22 which preferably results in a water resistant connection.

Figure 7:
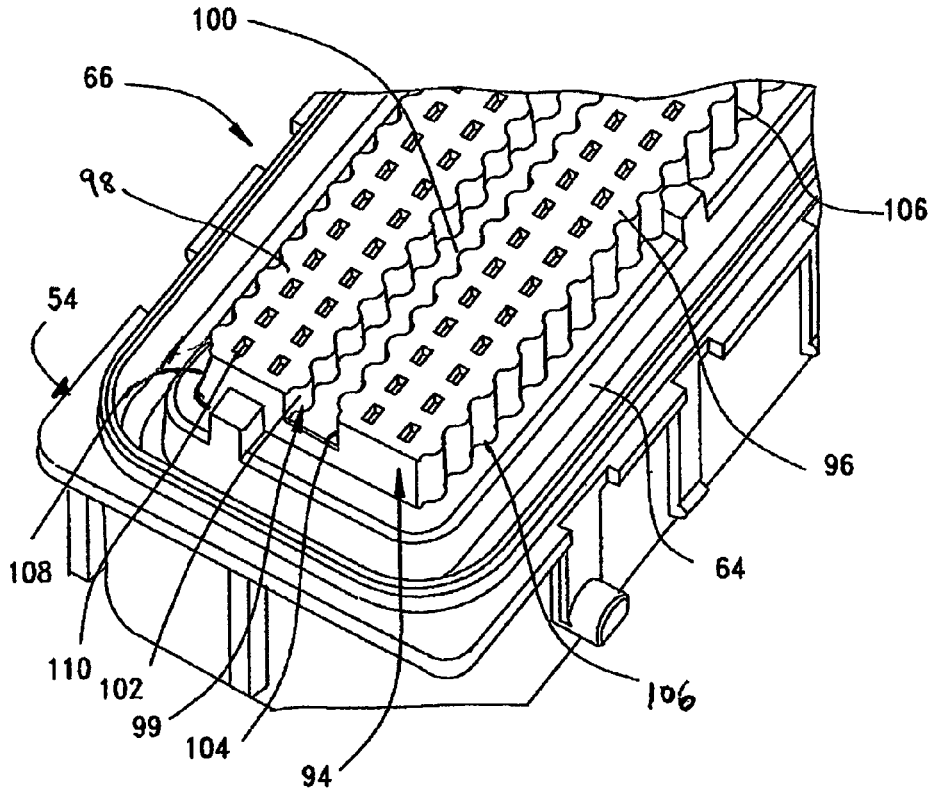
FIG. 7 is a perspective view of one embodiment of the PCB side of a shroud housing of the present invention.

Core 64 on the PCB side 66 of shroud housing 54 shown in FIG. 7 can have a raised platform 94. Raised platform 94 can have two pin blocks 96, 98 separated by channel 100. Each pin block 96, 98 can have multiple pin passages or openings 110 arranged in two rows to accept compliant pins 21 therethrough. One or more larger pin openings may be needed depending on the type of compliant grounding pin if any is utilized. Inner sidewalls 102, 104 that form channel 100 can be wavy or undulating as opposed to flat as can outer sidewalls 106, 108 which are opposite to inner sidewalls 102, 104. These wavy surfaces can reduce air bubble formation if an elastomeric sealant is applied on the PCB side of die cast housing bay. Even small air pockets can expand during a heating or curing process of an elastomeric sealant so any reduction in air entrapment is advantageous. Also, as shown in FIG. 7, the peaks of the individual wave surface can be in alignment with pin openings 110 and provide reinforcement of the sidewall at the pin opening position.

As shown in FIG. 5, elastomeric sealant 112 can be used to fill flood area on PCB side 28 of bay 16 up to a level just below pin alignment plate 56 to cover what would otherwise be exposed surfaces of the terminals 21 after one side of shroud assembly is connected to PCB and complementary connectors are connected to the other side of the shroud assembly. Sealant 112 can be any polymer or polymer system that will provide needed assembly characteristics, typically upon curing such as heat curing. Such polymers or polymer systems should be resistant to vibration, temperature fluctuation and moisture depending on the environment the control module will be exposed to. A typical sealant is a silicone polymer but others such as urethane based, epoxy or plastic polymers can be used. Sealant 112 seals the pin openings 110, gap 114 between the dies cast housing 12 and shroud assembly 22 and also can reinforce and/or protect adhesive 74.

Figure 8:
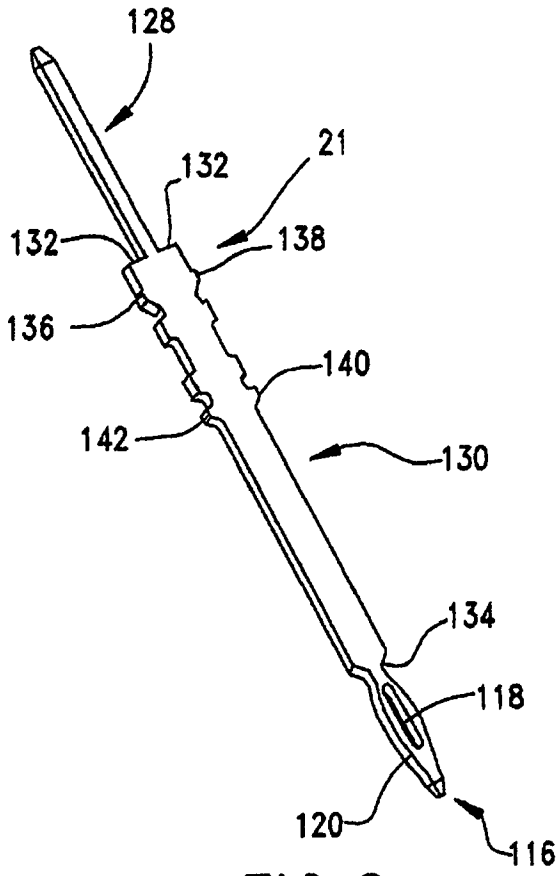
FIG. 8 is a perspective view of one embodiment of a compliant pin terminal of the present invention.
Figure 10:
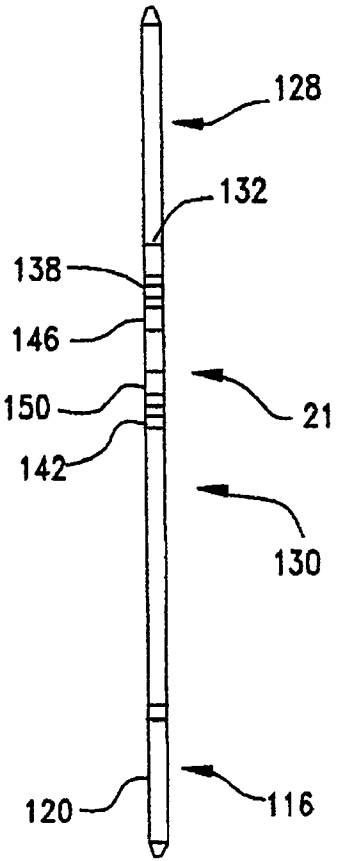
FIG. 10 is a side elevation view of the compliant pin terminal shown in FIG. 8.
Figure 9:
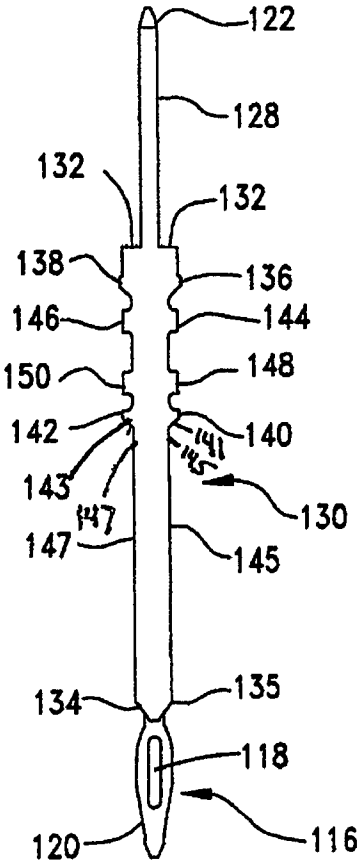
FIG. 9 is a front elevation view of the compliant pin shown in FIG. 8

One embodiment of compliant pin terminal 21 is shown in FIGS. 8, 9 and 10. Compliant pin terminals are formed of a conductive material and while compliant pin terminals can have any number of size and shape configurations such as linear or right angled, one common feature is a compliant pin tip 116. Tip 116 has a central elongated opening 118 that permits the pear-shaped or spear-shaped body 120 to contract radially to permit tip 116 to be inserted into an opening 124 in the PCB 126 shown in FIG. 5. Opening 124 extends through entire thickness of PCB 126. Opposite tip 116 is mating bar 128. In the embodiment of a compliant pin shown in FIGS. 8-10 the mating bar has a square cross-section having 0.64 mm sides. Mating bar 128 makes electrical contact with a complementary connector and can have a tapered contact end 122. Shaft 130 extends between tip 116 and bar 128. At the interface of mating bar 128 and shaft 130 is push shoulder 132. Shaft 130 can taper inwardly to form throat 134 at the interface with tip 116. In addition, shaft 130 can be tapered such that the width at push shoulder 132 is greater than the width of shaft end 135.

At the base of shaft 130 adjacent push shoulder 132, the shaft 130 may have a pair of base barbs 136, 138. Each of base barbs 136, 138 can extend out an equal distance on opposite sides of shaft 130 and beyond the width of the base of shaft 130 at push shoulder 132. Further along the shaft 130 towards the tip 116, shaft 130 can have a pair of leading barbs 140, 142 that extend out on opposite sides of shaft 130. Each of leading barbs 140, 142 can extend an equal distance beyond the width of the base of shaft 130 but not a far as base barbs 136, 138. Since compliant pin terminal 21 are inserted tip 116 first through pin opening 110 on mating side 62 of shroud housing 54, leading barbs 140, 142 are the first to contact inner walls 113 (shown in FIG. 16). Having the leading barbs not extend out from the sides of shaft 130 as much as base barbs 136, 138 prevents pin opening 110 from being deflected open to such a degree that base barbs 136, 138 may not properly or sufficiently engage inner walls 113. In other words, having the leading barbs 140, 142 not extend out from the sides of shaft 130 as far out as base barbs 136, 138 allows both sets, leading barbs 140, 142 and base barbs 136, 138 to sufficiently engage inner walls 113 and to securely retain compliant pin terminals 21 within pin openings 110.

Shaft 130 can also include two pairs of spaced apart carrier tabs 144, 146, 148, 150. Each pair of carrier tabs 144, 146, 148, 150 extend out an equal distance on opposite sides of the shaft 130 a distance less than that of the leading barbs 140, 142. The size and shape of the carrier tabs usually is determined by severance of the pin terminals from a carrier member having a plurality of pins extending therefrom, such carrier arrangements being generally known for simultaneous multiple placement of pins.

The edges 141, 143 closest to tip 116 can intersect with respective edges 145, 147 at an obtuse angle. This obtuse angle of the leading barbs 140, 142 allows for spacing between leading barbs 140, 142 and chamfered ends of pin openings 110 which will be discussed in more detail below.

This spacing provides collection volume for shroud housing debris from the inner walls 113 of pin openings 110 that can be shaved off by leading barbs 140, 142 and that could otherwise prevent the full seating of compliant pin terminal 21 in pin opening 110.

In the embodiment shown in FIGS. 8-10, compliant pin terminal 21 is stamped from a brass alloy sheet metal having a thickness of about 0.64 mm. The length from end of tapered end 122 to end of tip 116 can be about 25 mm to about 30 mm. The width at push shoulder 132 can be between about 1.5 mm and about 2 mm and the length from push shoulder 132 to end of tip 116 can be from about 18 mm to about 20 mm, for example. Leading retention barbs 140, 142 can extend out from their intersection with shaft 130 about 0.3 mm and base barbs can extend out from their intersection from shaft about 0.4 mm. Tip 116 can be tin plated and bar 128 can be gold plated. A series of compliant pins 21 can be stamped as a strip of compliant pins 21 joined at carrier tabs. A stitching machine (not shown) can shear the compliant pin from the strip and insert it into pin openings 110.

Figure 13:
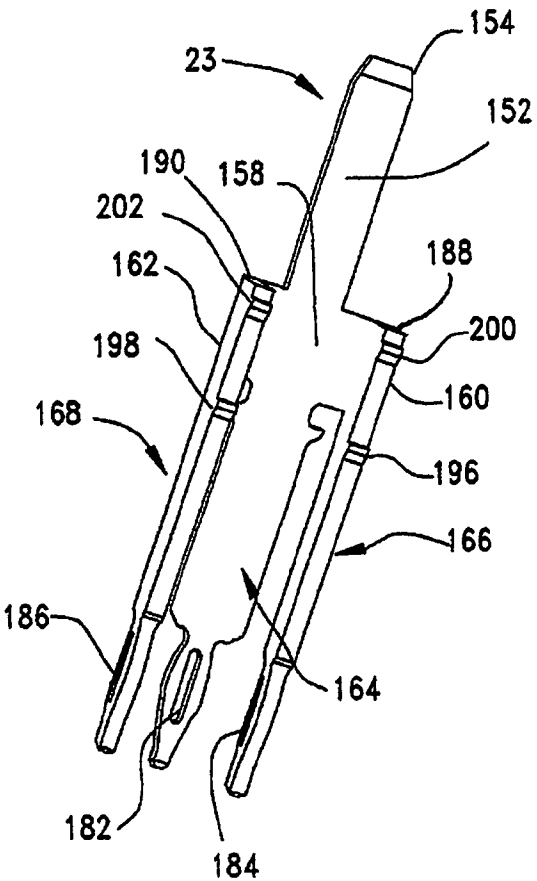
FIG. 13 is
Figure 12:
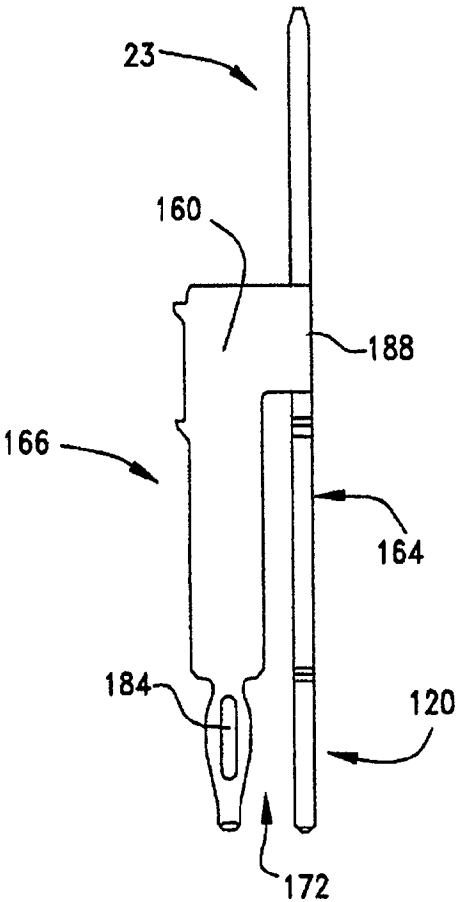
FIG. 12 is a side elevation view of the compliant pin grounding terminal shown in FIG. 11.
Figure 11:
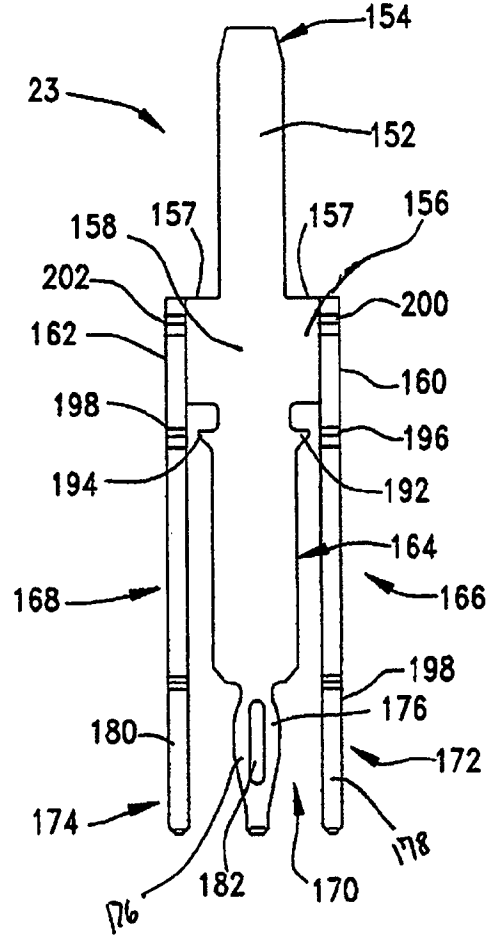
FIG. 11 is a front elevation view of one embodiment of a three-prong U-shaped compliant pin grounding terminal of the present invention.

One embodiment of a compliant pin grounding terminal can have a three-prong structure. Three-prong compliant pin grounding terminal 23 is shown in FIGS. 11-13. It is noted that grounding can be accomplished with a compliant pin terminal such as compliant pin terminal 21. Compliant pin terminal 21 can safely handle about 5 amps of current. Three-prong compliant pin grounding terminal 23 can safely handle about 24 amps of current. Grounding terminal 23 can have a mating blade 152 for contacting a complementary connector (not shown). Terminal blade end 154 can be tapered inwardly. Cross member 156 can extend at a right angle to blade 152. The blade-side surface of cross member 156 forms push shoulder 157.

Extending from a center portion 158 and end portions 160, 162 of cross member 156 in a direction opposite blade 152 can be central shaft 164, and end shafts 166, 168 respectively. At the ends of shafts 164, 166, 168 are PCB tips 170, 172, 174 respectively that have a pear-shaped or spear-shaped bodies 176, 178, 180 and centrally located elongated opening 182, 184, 186. Cross member 156 shown in FIGS. 11-13 has two radiused right angle bends 188, 190, bending in the same direction such that cross member ends 160, 162, end shafts 166, 168 and PCB tips 172, 174 lay on respective planes generally perpendicular to the plane of the blade to form a U-shape such as shown in representational drawing 13*a*. Alternatively, only one of cross member ends 158, 160 can be bent at a right angle in a plane perpendicular to the plane of blade 152 to form an L-shape such as shown in representational drawing 13*b*. The L-shape configuration reduces the amount of heat build up at the tips and shafts as compared to a three prong terminal having its tips, shafts and cross-member laying on the same plane but does not reduce heat build up as efficiently as the U-shape configuration.

Figure 13A:
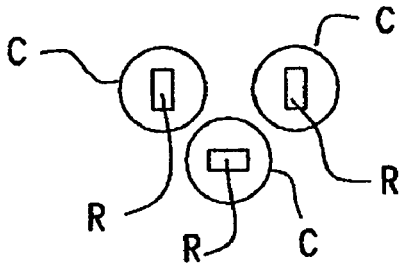
FIG. 13*a* is a plan view representation of one embodiment of a three-prong U-shaped compliant pin grounding terminal of the present invention.
Figure 13B:
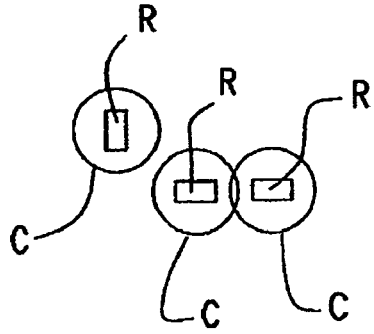
FIG. 13*b* is a plan view of one embodiment of a three-prong L-shaped compliant pin grounding terminal of the present invention.

Heat buildup, which reduces current flow through the grounding terminal, is reduced by increasing the spacing between the shafts of the terminal. An illustration of this concept is shown in cross-sectional representation of a U-shaped three-prong grounding terminal shown in FIG. 13*a* and an L-shaped three-prong grounding terminal 13*b*. Rectangle "R" represents the cross-section of shafts of grounding pin terminal, and circles "C" represent heat radiating from shafts "R". Intersecting circles are areas of heat build up. As is evident in FIGS. 13*a* and 13*b*, the spacing among all of the shafts "R" is greater for the U-shape than for the L-shape while both exhibit shaft spacing (given some terminal dimensions) than an in-line or linear orientation of the shafts "R".

Referring back to FIGS. 11-13, central shaft 164 can have a pair of aligned and opposing retention barbs 192, 194 located adjacent central portion 158 of cross member 156. End shafts 166, 168 can also include retention barbs 196, 198 at a position aligned with retention barbs 192, 194 and cross member ends 160, 162 can also include retention barbs 200, 202 at an end closest to blade 152. Retention barbs 196, 198, 200, 202 extend in the same direction. Retention barbs 192, 194, 196, 198, 200, 202 help to retain ground pin 23 in ground pin opening.

Figure 14:
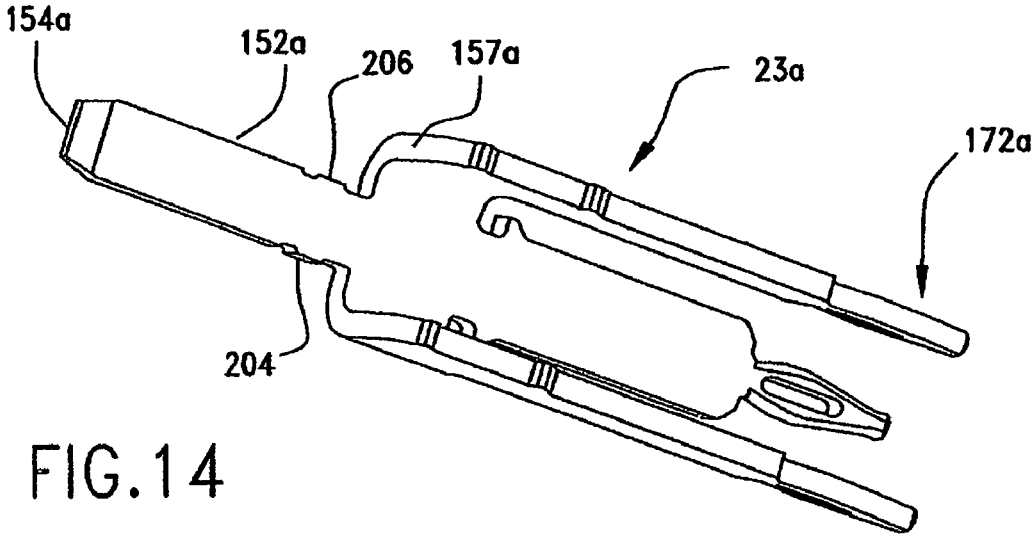
FIG. 14 is a perspective view of another embodiment of a three-prong U-shaped compliant pin grounding terminal of the present invention.

Three-prong grounding pin 23*a* shown in FIG. 14 is similar to three-prong grounding pin 23 in all respects except that blade 152*a* includes a pair of aligned and opposing carrier tabs 204, 206. As with compliant pin 21 discussed above, carrier tabs 204, 206 permit three-prong grounding pin 23*a* to be provided on a continuous strip of grounding pins 23*a* joined at carrier tabs 204, 206. In one embodiment, grounding pins 23, 23*a* can be stamped from 0.80 mm thick brass alloy sheet metal, and the end tips 170, 172, 174 can be tin-plated. The blade 152 can have a width of 2.8 mm. Spacing between the centers of end tips 172, 174 can be 5.68 mm and the spacing from either end tip 172, 174 to center tip 170 can be 2.84 mm. In one embodiment grounding pin 23 can have a length of about 30 mm measured from tapered end 154 to end of tip 170. The length from end of tip 172 to its respective push shoulder 157 can be about 18 mm to about 20 mm, which can be the same for the other two prongs of grounding pin 23. The width across push shoulder 157 can be about 6 mm. Retention barbs 192, 194 can extend out from their respective points of intersection with shaft 164 about 0.4 mm to about 0.5 mm. Retention barbs 196, 198, 200, 202 can extend out from their respective points of intersection with respective shafts 166, 168 about 0.4 mm to about 0.5 mm.

Figure 15:
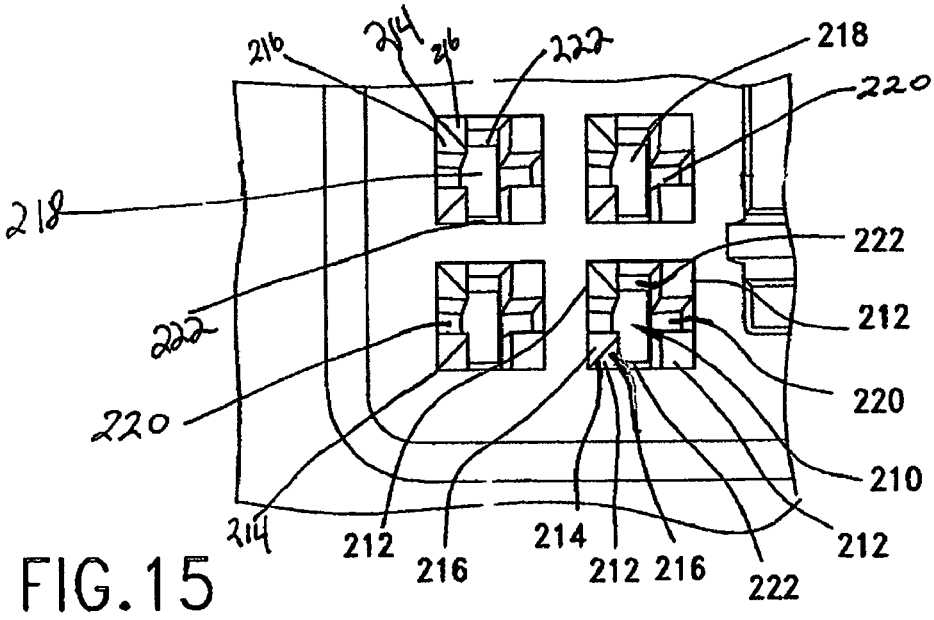
FIG. 15 is an elevation view of the mating side of the shroud housing shown in FIG. 7.

Pin openings 110 have PCB side opening 208 and mating side opening 210 as best shown in FIG. 5. Mating side opening 210 can have a "plus" shape or cross shape as shown in FIG. 15. Corner blocks 212 that define the plus-shaped mating opening 210 are square and can have a raised diagonal ridge line 214 with opposing halves 216 that slope downwards towards the PCB side opening 208. This helps to reduce points of stress on the housing at openings 210. One cross-member portion 218 of opening 110 can extend completely through to the PCB side opening 208. The other perpendicular cross-member portion 220 can extend only a partial distance towards PCB side opening 208. One benefit of plus-shaped mating opening 210 is that the portion of the die tool or the post of the mold that forms opening 110 has added structural support which can be helpful in resisting breakage of the die tool in view of the small dimensions of pin openings 110. A benefit of extending cross-member 220 only partially towards the PCB side opening 208 that sealant 112 shown in FIG. 5 does not leak through or is able to bridge any gaps before significant leakage to mating side 64 of shroud housing 54 occurs.

Figure 16:
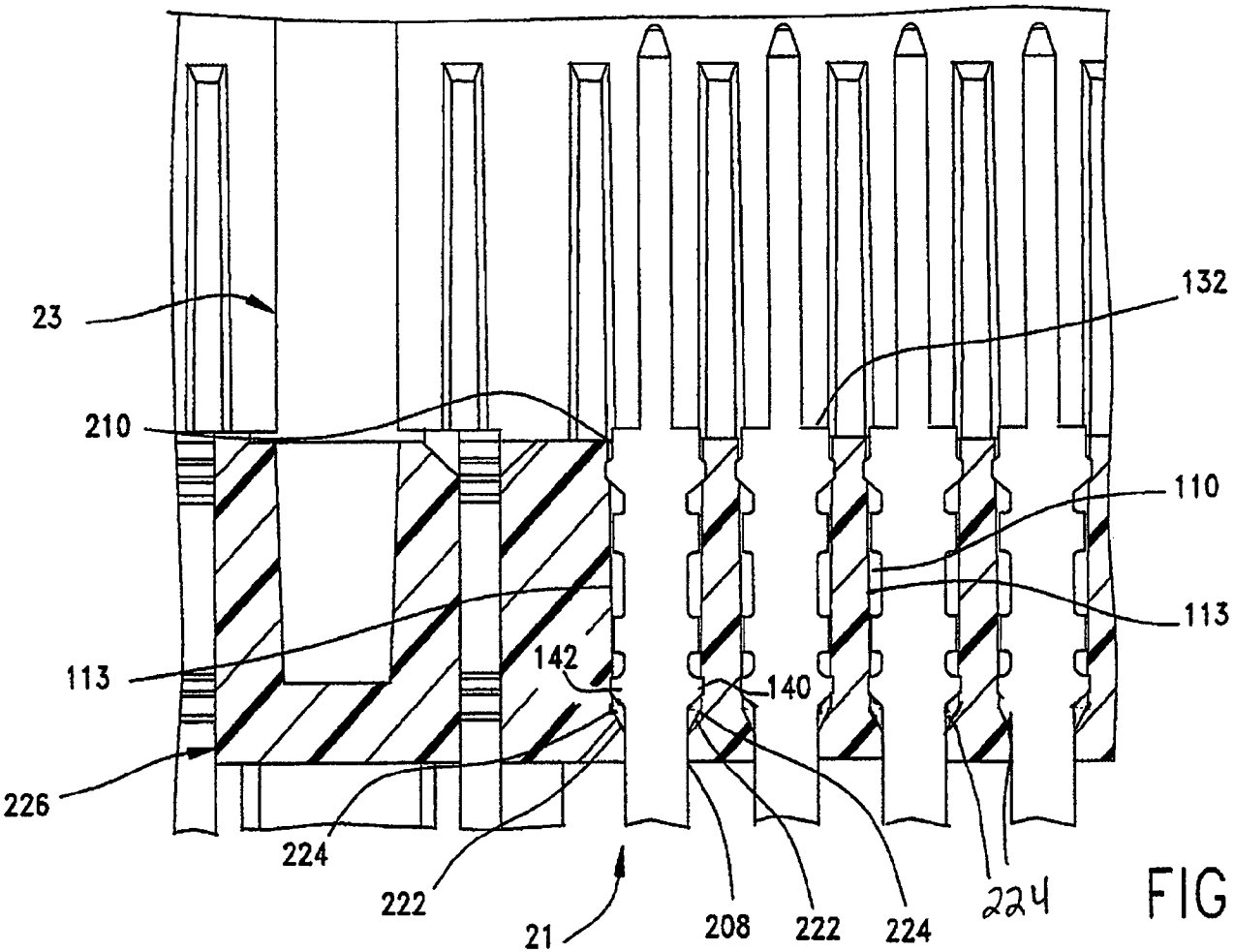
FIG. 16 is an elevation view of a cross-section of a portion of shroud assembly of the present invention showing compliant pin terminals in the compliant pin openings or passages and a three-prong U-shaped grounding terminal in a grounding pin opening or passage.

Cross-member portion 218 of opening 110 can neck inward or have chamfered sides 222 to narrow the PCB-side opening 210 so as to snugly fit the width of shaft 130 as best shown in FIG. 16. The chamfered sides 222 help guide pin 21 through opening 110 and form pockets 224 with leading barbs 140, 142. Opening 110 has a width slightly less than the width of pin 21 taken at the farthest extents of leading barbs 140, 142 and slightly larger than the base measured across push shoulders 132. Because pin opening 110 is narrower than leading barbs 140, 142 shavings can be created as pin 21 is inserted through opening 210. Pockets 224 can receive any such shavings which could otherwise prevent pin 21 from proper seating in pin opening 21.

FIGS. 4 and 16 also show one embodiment of grounding pin opening 226 for U-shaped three-prong grounding pin 23. As shown in FIG. 4, ground pin opening 226 on the mating side 62 can have a U-shape for accepting cross-member 158. On the PCB side 66 are three separate slot openings to accept each shaft 164, 166, 168. Retention barbs 192, 194, 196, 198, 200, 202 engage the inner walls to secure and align grounding pin 23 in grounding pin opening 226.

The assembly process of control module 10 typically includes metal casting of die cast housing 12. Die cast housing 12 is cast from aluminum but other metals or alloys can be used as noted herein. As shown in FIGS. 1 and 2, die cast housing 12 can have pads 38 which can be machined to obtain a flat top surface. Flat surface at each pad 38 provides a stable support for accurate and precise placement of one or more shroud assemblies 20, 22, 24. Precise and accurate placement of shroud assemblies 20, 22, 24 relative to the die cast housing 12 translates to precise and accurate positioning of compliant pin terminals 21 and ground terminal 23 if used. Without accurate and precise positioning of compliant pin terminals, PCB may not properly mate with and/or form complete electrical contact with the pin terminals. In addition to obtaining a flat surface, the vertical distance between PCB support ledge 40 and each pad is measured. If the any of the vertical distances are not within specified tolerances, the pad or pads 38 may be machined further to obtain the proper spacing between each pad 38 and PCB support ledge 40. This verification of spacing is results from the inherent variability in die casting of the module housing 12.

Shroud housing 54 can be made of plastic in many ways such as mold injection methods. Shroud housing 54 can then proceed to a stitching operation. A rolled up strip of compliant pins 21 (not shown) can be loaded into a stitching machine (not shown) of a type known in the art which singulates or separates a compliant pin 21 from the strip and pushes each pin 21 (tip 116 end) first using push shoulder 132 through mating side opening 210. The stitching machine is set to insert each compliant pin 21*a* set distance which can be short of the final seating position of the pin. If any additional grounding pin 23 is required it can be inserted in the same or similar manner.

Figure 17:
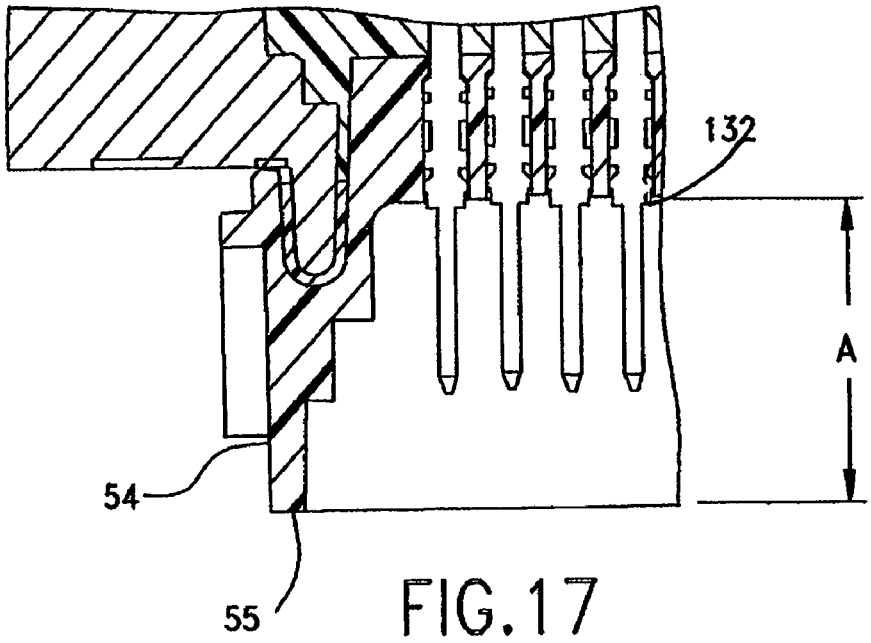
FIG. 17 is an elevation view of a cross-section of another embodiment of a compliant pin control module of the present invention showing the vertical distance between the shroud face and the push shoulders of the compliant pin terminals.

Shroud housing 54 having pins 21 and grounding pin 23 inserted into pin openings 110, and grounding pin opening 226, respectively is placed on a nest (not shown). The nest can have a series of pin supports (such as pin support towers 230 of alignment tool 228 discussed below) to support push shoulders 132 of pins 21 and 157 of grounding pin 23. The nest can also include a shroud housing support that is placed a predetermined distance "A" from the pin supports. The predetermined distance "A" is the vertical distance from the pin supports to the shroud housing support. In one embodiment the predetermined distance is about 17.3 mm. Shroud housing 54 can then be pushed against the nest until skirt face 55 contacts shroud housing support which causes compliant pins 21 and grounding pin 23 to be pushed further into pin openings 110 and grounding pin opening 226 respectively. Predetermined distance "A" is duplicated to the partially finished shroud assembly such that compliant pin push shoulders 132 and grounding pin shoulder 157 are spaced predetermined distance "A" from skirt face 55 as shown in FIG. 17.

While still on the nest, pin alignment plate 56 can then be mounted to compliant pins 21. The nest prevent compliant pins 21 and grounding pin 23 from being push out of position in openings 110 and 226 respectively. Pin alignment plate 56 is held in place by friction as the openings in the pin alignment plate 56 closely match the dimensions of pins 21 and grounding pin 23. The compliant pin terminals and grounding pins are retained in their respective passages or openings by their respective retention barbs and not by the push shoulders. The same steps can be performed to produce additional shroud assemblies. The next step is the mounting of a shroud assembly to the die cast housing.

The mounting of one shroud assembly will be described below but which is applicable to the mounting of more than one shroud assembly to a die cast housing.

Figure 18:
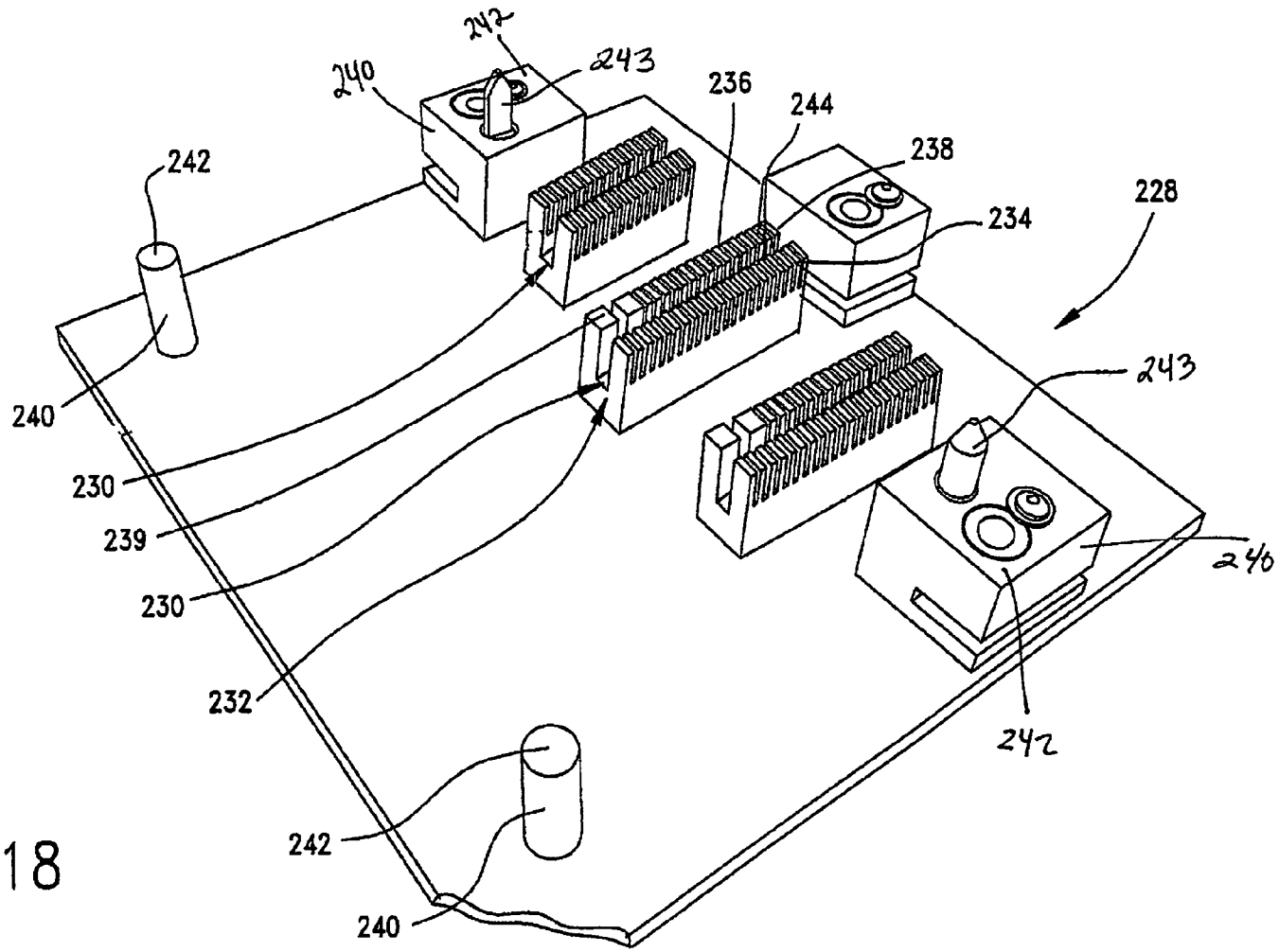
FIG. 18 is a perspective view of one embodiment of an alignment tool of the present invention.

Alignment tool 228 shown in FIG. 18 can be used to position shroud assembly 22 relative to die cast housing 12 during the mounting process. Alignment tool 228 can have one or more pin support towers 230 depending on the number of shroud assemblies to be mounted. Each pin support tower can have a row of fingers 232 wide enough to support two rows of compliant pins 21 at their push shoulders 132. Since shroud housing 54 of shroud assembly 22 has two pin blocks 96, 98 and each pin block 96, 98 has two rows of pin openings 21 as shown in FIG. 7, two rows of fingers 232 are provided. The fingers 234 are spaced apart to accommodate the mating bars 128 of compliant pins 21. Since there are 20 compliant pins per row of openings 110 as shown in FIG. 6 twenty one fingers 234 are included to provide twenty spaces 236, one for each pin 21. Second row of fingers 238 that includes wider fingers 239 is configured to support the two rows of sixteen pins 21 and a three-pronged grounding 23 at their respective push shoulders 132, 157 of shroud assembly 22 partially shown in FIGS. 1 and 4.

Posts 240 included in alignment tool 228 have top surfaces 242 set a predetermined distance "B" from the top surfaces 244 of fingers 234. Predetermined distance "B" is the vertical distance from top surface 244 of fingers 234 to top surface 242 of posts 240. In one embodiment, predetermined distance "B" can be about 1.61 mm.

Adhesive 74 is dispensed in groove 72 as shown in FIG. 5. The adhesive can be silicone based adhesive but could also be an epoxy or ceramic cement compound. Shroud assembly 22 is placed on support tower 230 so that push shoulders 132 contact top surfaces 244 of fingers 234. Die cast housing 12 is placed over shroud assembly 22 and rib 34 of bay 16 (see FIG. 2) is positioned in groove 72 and pads 38 are positioned over posts 240. Orientation rods interface with cavities 245 shown in FIG. 1 to assist in orienting control module housing 12 to alignment tool 228. Die cast housing 12 is lowered onto alignment toll 228 so that shroud assembly passes through bay 16 and until die cast housing contacts or engages alignment tool 228 so that pads 38 contact posts 240. The die cast housing is retained in this position as the adhesive is cured typically through heat treatment. When the curing process is over and shroud assembly 22 is fixed to die cast housing 12, predetermined distance "B" is consequently duplicated such that the vertical distance from push shoulders 132 to any of pads 38 is predetermined distance "B" as shown in FIG. 19.

Figure 19:
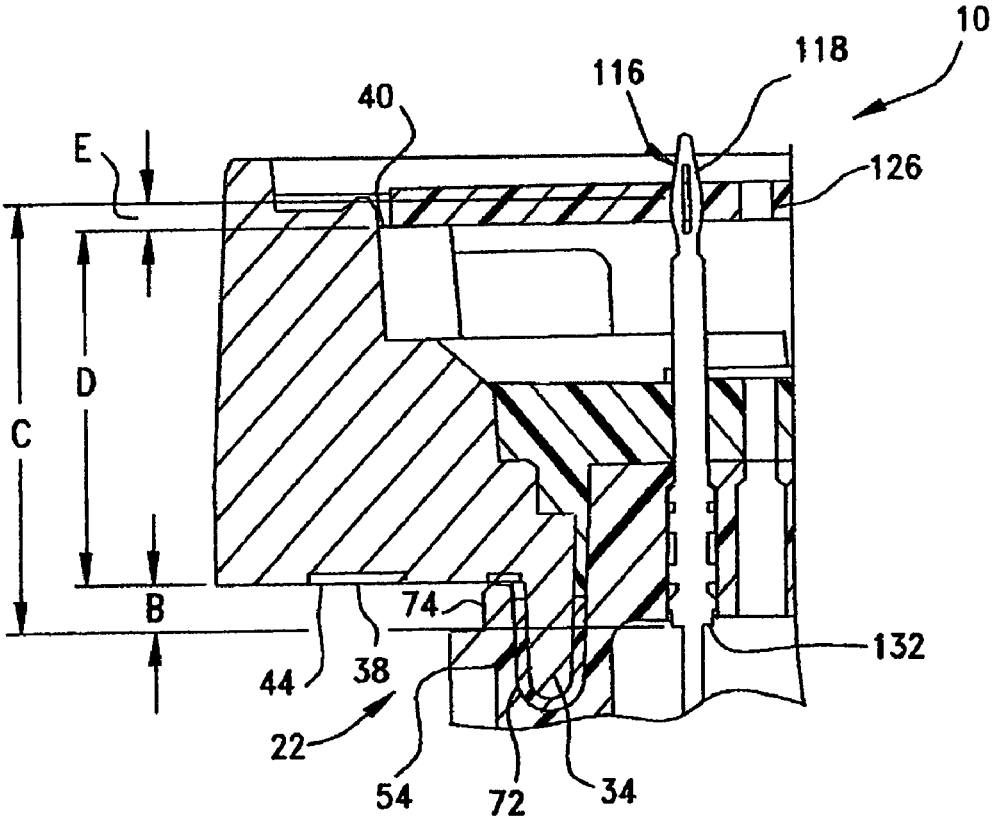
FIG. 19 is an elevation view of the cross-section of the compliant pin control module shown in FIG. 17 showing the vertical distance between the push shoulder of the compliant pin terminal and the pad of control module housing, the vertical distance between the pad of control module housing and the PCB ledge, and the thickness of a PCB seated on PCB ledge.

As shown in FIG. 19, three other measurements can affect the accurate and precise placement of compliant pins 21 relative to die cast housing 12 to ensure pin tips 116 make a complete seating and proper electrical connection to PCB 126. Predetermined distance "C" is the vertical distance from push shoulder 132 to the center of elongated opening 118 of compliant pin tip 116. In one embodiment, predetermined distance "C" can be about 16.4 mm. Predetermined distance "D" is the vertical distance from pad 38 to PCB support ledge 40. In one embodiment, predetermined distance "D" can be about 14.0 mm. Predetermined distance "E" is the vertical distance from PCB support ledge 40 to center of elongated opening 18 of compliant pin tip 116. Although not shown to scale in FIG. 19, the thickness of PCB 126 is twice predetermined distance "E". In one embodiment, predetermined distance "E" can be about 0.79 mm and PCB thickness can be 1.58 mm. Alteration of any of predetermined distances A-E can result in altering the remaining predetermined distances.

Once one or more shroud assemblies are mounted to the control module housing, a PCB is ready to be mounted to the control module. The force required to mount the PCB to the control module varies with the number of total compliant pins in the module. For a control module such as control module 10 shown in FIG. 1, three thousand pounds of pressure may be necessary to force the tips of compliant pin terminal through holes in the PCB. It is preferably to prevent this force from being applied to the shroud assembly especially if the shroud housing is made of plastic to avoid deformation of the shroud housing and possible resulting movement of the terminals. A PCB assembly tool similar to alignment tool 228 is utilized to support compliant pin terminals and grounding terminals at their respective push shoulders instead of having supports in the shroud housing that engage the push shoulders since this could result in the above issues.

While the present invention has been described in detail with reference to the foregoing embodiments, other changes and modifications may still be made without departing from the spirit or scope of the present invention. It is understood that the present invention is not to be limited by the embodiments described herein. Indeed, the true measure of the scope of the present invention is defined by the appended claims including the full range of equivalents given to each element of each claim.

The invention claimed is:

1. A control module comprising:

a module housing having opposing first and second sides and a bay opening therethrough;

a connector extending through the bay and mounted to the module housing, the connector including a housing having a printed circuit board side and a mating side and a core on the printed circuit board side of the housing, the core including passages having opposing first and second openings, the first opening positioned at the printed circuit board side of the housing and the second opening positioned at the mating side of the housing; and a plurality of conductive terminals, each conductive terminal extending through one of the passages and having a compliant pin portion at one end of the conductive terminal for insertion in a hole in a printed circuit board and a contact portion at an opposite end of the conductive terminal for insertion in an opening in a complementary connector, the compliant pin portion extending out from the first opening and towards the printed circuit board side and the contact portion extending out from the second opening and towards the mating side of the connector housing wherein said first side of said module housing includes a printed circuit board support for accepting a printed circuit board thereon and said second side of said module housing includes at least one pad as a reference point for positioning the connector such that compliant pin portions are positioned to enter holes in the printed circuit board and an elongated opening of each compliant pin portion is centered within said respective holes of said printed circuit board.

2. The control module of claim 1, wherein the module housing includes a rib circumscribing the at least one bay and extending from the second side of said module housing.

3. The control module of claim 2, wherein the mating side of the housing includes a skirt having a skirt face and the printed circuit board side of the housing includes a groove surrounding the core for accepting adhesive and mating with the rib to mount the connector to the module housing.

4. The control module of claim 3, wherein an adhesive fixes said rib to said groove to mount the connector to the module housing.

5. The control module of claim 4, wherein the bay and the printed circuit board side of the connector housing define a flood area, the flood area being filled with a sealant.

6. The control module of claim 3, further comprising an alignment tongue positioned on the mating side and in a cavity defined by the skirt.

7. The control module of claim 1, wherein each conductive terminal includes at least one barb to secure said conductive terminal in said passage and a push shoulder between the compliant pin portion and the contact portion for supporting the conductive terminal during insertion of said compliant pin portion in said opening in the printed circuit board.

8. The control module of claim 1, wherein the second opening is cross-shaped.

9. The control module of claim 8, wherein the cross-shaped opening is defined by first and second perpendicular portions.

10. The control module of claim 9, wherein the first portion extends partially through each of the plurality of passages and the second portion extends through each of the plurality of passages beyond the first portion.

11. The control module of claim 10, wherein the second portion narrows at the first opening.

12. The control module of claim 1, wherein the core includes at least one undulating sidewall having a plurality of peaks.

13. The control module of claim 12, wherein each peak of the undulating sidewall is aligned with one of the passages.

14. The control module of claim 13, wherein each passage is aligned with and adjacent to one of the plurality of peaks.

15. The control module of claim 1, further comprising a grounding terminal having three compliant pin portions and one blade contact portion and wherein the core includes a grounding pin passage having one aperture at one end of the grounding pin passage and three apertures at an opposite end of the grounding pin passage, each of the three compliant pin portions extending out from one of the three apertures at the opposite end and the blade contact portion extending out from the aperture at the one end.

16. The control module of claim 15, wherein the three compliant pin portions of the grounding terminal are arranged in a U-shape.

17. The control module of claim 1, wherein predetermined distance X equals the vertical distance between the push shoulder and the center of the elongated opening of the compliant pin portion and predetermined distance Y equals the vertical distance between the pad and the printed circuit board support plus one-half the thickness of the printed circuit board, and the vertical distance between the push shoulder and the pad equals predetermined distance X minus predetermined distance Y.

18. The control module of claim 1, wherein the module housing is a die cast housing.

19. An electrical connector comprising:

a housing having a printed circuit board side and a mating side and a core on the printed circuit board side, the core including a plurality of passages having opposing first and second openings;

a plurality of conductive terminals, each conductive terminal extending through one of the plurality of passages and having a compliant pin portion at one end of the conductive terminal for insertion in a hole in a printed circuit board having a predetermined thickness and a contact portion at an opposite end of the conductive terminal for insertion in an opening in a complementary connector, the compliant pin portion extending out from the first opening and towards the printed circuit board side and the contact portion extending out from the second opening and towards the mating side; and a terminal alignment plate having a plurality of slots, said compliant pin portion of each terminal extending through a respective one of the plurality of slots.

20. The electrical connector of claim 19, wherein each conductive terminal includes at least one barb to secure conductive terminal in the passage and a push shoulder between the compliant pin portion and the contact portion for supporting the conductive terminal during insertion of the compliant pin portion in the hole of the printed circuit board.

21. The electrical connector of claim 19, wherein the second opening is cross-shaped.

22. The electrical connector of claim 21, wherein the cross-shaped opening is defined by first and second perpendicular portions.

23. The electrical connector of claim 22, wherein the first portion extends partially through each of the plurality of passages and the second portion extends through each of the plurality of passages beyond the first portion.

24. The electrical connector of claim 23, wherein the second portion narrows at the first opening.

25. The electrical connector of claim 19, wherein the core includes at least one undulating sidewall having a plurality of peaks.

26. The electrical connector of claim 25, wherein each peak of the undulating sidewall is aligned with one of the plurality of passages.

27. The electrical connector of claim 26, wherein each passage is aligned with and adjacent to one of the plurality of peaks.

28. The electrical connector of claim 19, wherein the mating side includes a skirt having a skirt face and the printed circuit board side includes a groove surrounding the core.

29. The electrical connector of claim 28, further comprising an alignment tongue on extending towards the mating end and positioned in a cavity defined by the skirt.

30. The electrical connector of claim 19, further comprising a grounding terminal having three compliant pin portions and one blade contact portion and wherein the core includes a grounding pin passage having one aperture at one end of the grounding pin passage and three apertures at an opposite end of the grounding pin passage, each of the three compliant pin portions extending out from one of the three apertures at the opposite end and the blade contact portion extending out from the aperture at the one end.

31. The electrical connector of claim 30, wherein the three compliant pin portions of grounding terminal are arranged in a U-shape.

32. A method of making a control module comprising the steps of:

providing a control module housing having opposing first and second sides and a bay opening therethrough, the second side including at least one pad;

providing a connector including a plurality of terminals, each terminal having a compliant pin portion at one end of the terminal for insertion in a hole in a printed circuit board, a contact portion at an opposite end of the terminal for insertion in an opening in a complementary connector, and a push shoulder therebetween, each terminal extending through and secured to one of the passages;

providing an alignment tool including a pin support tower having a top surface and at least one post having a top surface, the top surfaces vertically spaced apart a predetermined distance X from each other;

placing the connector on the alignment tool wherein the push shoulders are supported on the pin support tower; and mounting the connector to the control module housing including the steps of bringing the control module housing and connector together such that the connector is positioned in the bay opening and at least one pad contacts at least one post.

33. The method of claim 32, wherein the step of providing a control module housing further comprises the step of casting the control module housing from a metal or metal alloy to have a support ledge on the first side of the control module housing for supporting a printed circuit board having a thickness, determining the vertical distance from the pad to the support ledge, machining the pad so that the support ledge is vertically spaced apart from the pad a predetermined distance Y.

34. The method of claim 32, wherein the step of providing a connector further comprises the steps of providing a connector housing having a plurality of passages for accepting terminals; providing a plurality of terminals, each terminal having a compliant pin portion at one end of the terminal, a contact portion at an opposite end of the terminal, and a push shoulder therebetween; and applying a force against the push shoulder of each terminal to insert each terminal into a respective passage.

35. The method of claim 33, wherein the step of providing a connector further comprises providing a pin alignment plate having a plurality of slots; and applying the pin alignment plate onto the terminals such that each compliant pin portion passes through one of the plurality of slots.

36. The method of claim 32, wherein the step of mounting the connector to the control module housing further comprises providing a control module housing having a rib on the second side of the control module housing and a connector housing having a core extending towards a printed circuit board side of the connector and a groove surrounding the core, adding an adhesive to the groove; bringing the control module housing and the connector together to mate the rib to the groove; and allowing the adhesive to set.

37. The method of claim 32, wherein the method of making a control module further includes adding an elastomeric sealant to a flood fill area defined by the bay and the printed circuit board side of the connector housing and allowing the elastomeric sealant to set.

38. A control module comprising:

a module housing having opposing find second sides and a bay opening therethrough;

a connector extending through the bay and mounted to the module housing, the connector, including a housing having a printed circuit board side and a mating side and a core on the printed circuit board side of the housing, the core including passages having opposing first and second openings, the first opening positioned at the printed circuit board side of the housing and the second opening positioned at the mating side of the housing;

a plurality of conductive terminals, each conductive terminal extending through one of the passages and having a compliant pin portion at one end of the conductive terminal for insertion in a hole in a printed circuit board and a contact portion at an opposite end of the conductive terminal for insertion in an opening in a complementary connector, the compliant pin portion extending out from the first opening and towards the printed circuit board side and the contact portion extending out from the second opening and towards the mating side of the connector housing; and a terminal alignment plate having a plurality of slots, said compliant pin portion of each terminal extending through a respective one of the plurality of slots.

* * * * *